US005983694A

United States Patent [19]

Woodrow et al.

[11] Patent Number: 5,983,694

[45] Date of Patent: Nov. 16, 1999

[54] ROLLING MILL ROLL STAND

[75] Inventors: Harold E. Woodrow, Northboro; T. Michael Shore, Princeton, both of Mass.

[73] Assignee: Morgan Construction Company, Worcester, Mass.

[21] Appl. No.: 09/085,924

[22] Filed: May 28, 1998

[51] Int. Cl.[6] ..... B21B 31/08

[52] U.S. Cl. ..... 72/238

[58] Field of Search ..... 72/237, 238, 239, 72/241.2, 241.4, 240, 248, 225

[56] References Cited

U.S. PATENT DOCUMENTS 3,490,256 1/1970 O'Brien ..... 72/240
3,948,072 4/1976 Aramaki .
4,121,446 10/1978 Passoni et al. .
4,148,206 4/1979 Meurer et al. .
4,279,140 7/1981 Gana et al. .
4,557,130 12/1985 Bond .
4,686,845 8/1987 Svagr ..... 72/239
4,715,206 12/1987 Forni .
4,944,175 7/1990 Mills et al. ..... 72/238

*Primary Examiner*—Rodney Butler
*Attorney, Agent, or Firm*—Samuels, Gauthier & Stevens

[57] ABSTRACT

A housingless roll stand has a pair of work roils supported between bearing chocks for rotation about parallel axes. The bearing chocks are mechanically engaged by nuts which in turn are threadedly engaged by opposite hand screw segments on spindles. The spindles serve both to effect symmetrical roll parting adjustments, and to provide a short stress path loop for absorbing roll separating forces during rolling. The nuts and associated adjusting spindles are separable from the bearing chocks, thus enabling them to remain as permanent on line fixtures when making roll changes.

15 Claims, 3 Drawing Sheets

ROLLING MILL ROLL STAND

BACKGROUND OF THE INVENTION

1. Field of the Invention

This inventions relates generally to rolling mills, and is concerned in particular with so-called "housingless" roll stands where the roll separating forces are absorbed by threaded spindles which extend between the bearing chocks of the work rolls.

2. Description of the Prior Art

In the conventional housingless roll stand, the work rolls are supported between bearing chocks for rotation about parallel axes. The bearing chocks include integral nuts which are threadedly engaged by opposite hand screw segments on spindles extending between adjacent bearing chocks of the respective work rolls. The spindles serve both to effect symmetrical roll parting adjustments, and to provide a short stress path loop for absorbing roll separating forces during rolling.

Typically, spare roll package assemblies are maintained off line for quick interchangeability when the mill is down for maintenance. Because the nuts and adjusting spindles are integrally associated with their respective bearing chocks, a multiplicity of nuts and adjusting spindles are required to outfit not only the on line roll packages, but also the off line spares. This translates into a high and extremely burdensome capital investment.

SUMMARY OF THE INVENTION

In accordance with the present invention, the nuts and associated adjusting spindles are totally divorced from the bearing chocks, thus enabling them to remain as permanent on line fixtures. The number of nuts and associated threaded spindles may thus be reduced to that required to service the active on line roll stands. The spare roll package assemblies remain free of these costly components, resulting in a significant decrease in capital investment.

These and other objects, features and advantages of the present invention will now be described in greater detail with reference to the accompanying drawings wherein:

DESCRIPTION OF PREFERRED EMBODIMENTS

Figure 2:
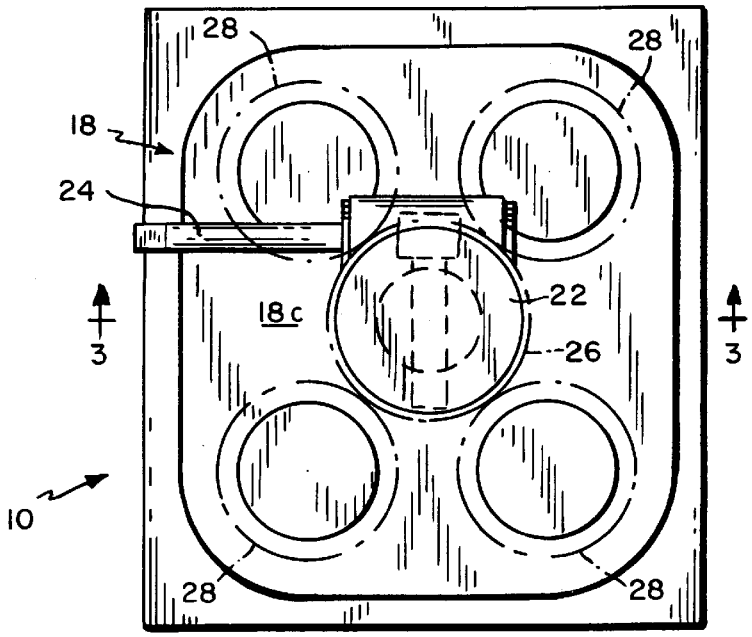
FIG. 2 is a top plan view of the roll stand shown in FIG. 1.

With reference to the drawings, a rolling mill roll stand in accordance with the present invention is generally depicted at 10. The roll stand includes a roll package 12 located on the mill pass line "P" within a frame having four corner posts 14 which protrude vertically from a base 16 and are interconnected at their upper ends by a head structure 18. The head structure has a bottom 18*a,* side 18*b* and a top 18*c* defining an interior chamber 20. A worm gear reducer 22 is mounted on the head structure 18 exteriorly of the chamber 20. The gear reducer has a manually operable horizontal input shaft 24 and a vertically depending output shaft 25 carrying a drive gear 26. Gear 26 meshes with four driven gears 28 rotatably fixed to the upper ends of spindles 30 which depend through the bottom 18*a* of head structure 18.

The spindles 30 extend downwardly through upper and lower nut members 32, 34. Opposite hand threaded segments 30*a,* 30*b* on the spindles 30 are in threaded engagement respectively with the upper and lower nut members 32, 34.

Figure 5:
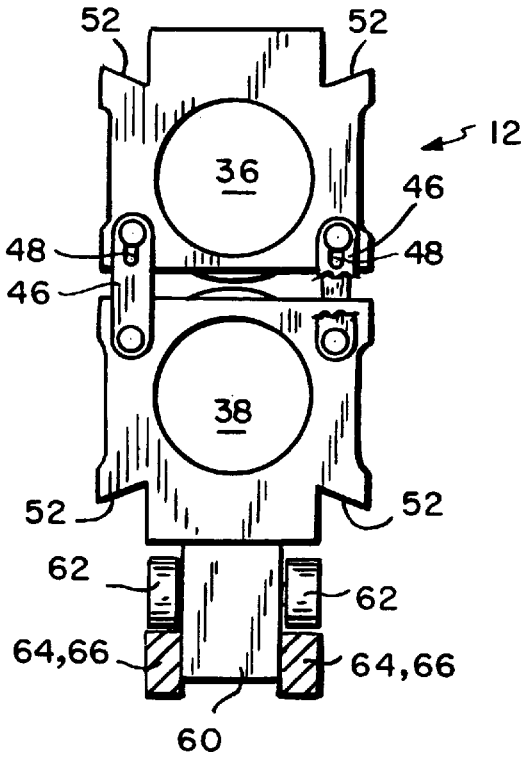
FIG. 5 is and end view of a roll package removed to one side of the mill pass line.

The roll package 12 includes a pair of work rolls 36, 38 supported respectively for rotation about parallel axes by bearings (not shown) contained in bearing chocks 40, 42. Hydraulic separators 44 are interposed between the adjacent chocks 40, 42 of each work roll. The separators yieldably urge the chocks apart to thereby maintain a separation between the work rolls. As can best be seen in FIG. 5, vertical links 46 are connected at opposite end to the chocks 40, 42. The links have slots 48 which accommodate the working range of roll parting adjustments.

The nut members 32, 34 have inclined faces 50 arranged to engage oppositely inclined faces 52 on the respective chocks. The angle of inclination of the faces 50, 52 with respect to the vertical is selected to generate resulting forces which pull the nut members against the chocks, and is preferably not greater than 75°. Tubular sleeves 54 on the upper nut members 32 cooperate with openings in the bottom 18*a* of head structure 18 to provide a guiding and locating function. Similar sleeves 56 depend from the lower nut members 42 to coact with stationary guides 58 forming part of the frame structure.

Figure 3A:
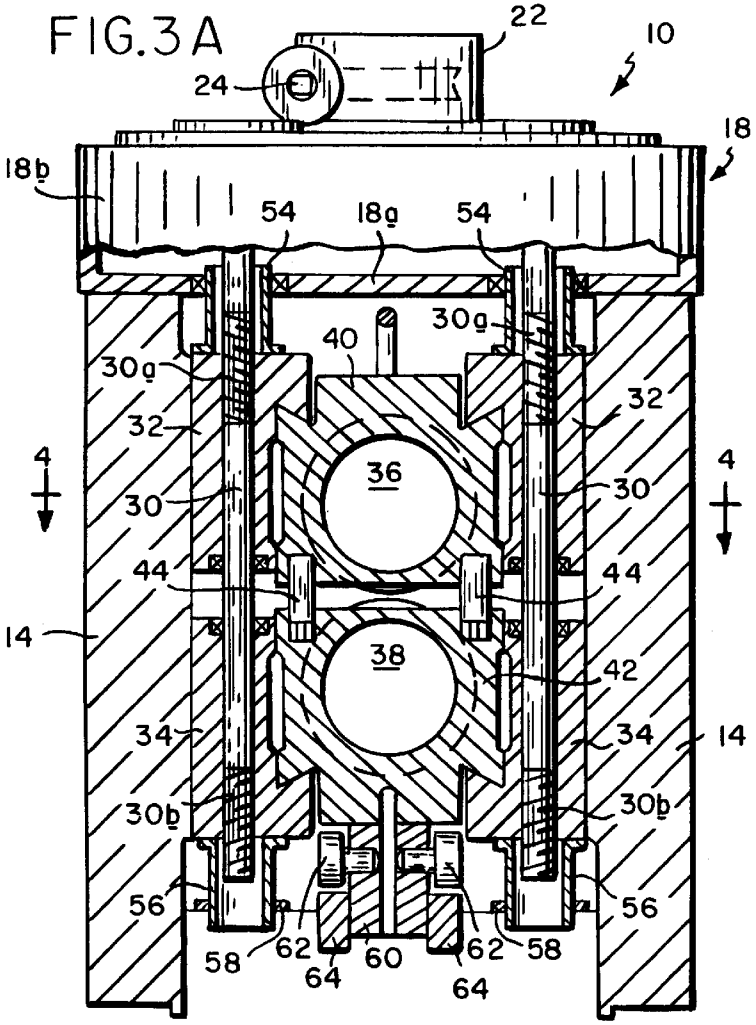
FIG. 3A is a sectional view taken along line 3—3 of FIG. 2 and showing the bearing chocks of the roll package operatively engaged by the nut members.

The lower chocks 42 include depending keels 60 which carry support wheels 62. Tracks 64 underlie the wheels 62. During rolling and throughout the working range of roll parting as shown in FIG. 3A, the nut members 32, 34 are closed symmetrically by rotation of the spindles 30 to engage the chocks 40, 42. The lower chock support wheels 62 are thus elevated above the underlying tracks 60. The inclined surfaces 50, 52 coact to firmly lock the nut members against the chocks.

Figure 3B:
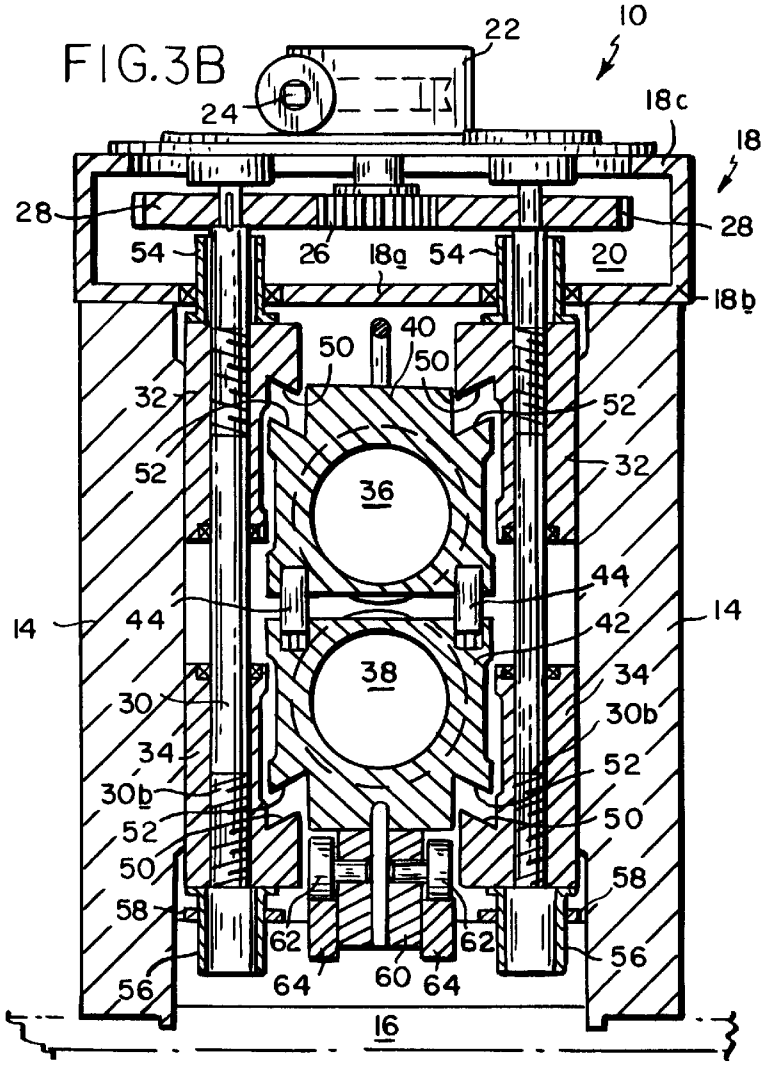
FIG. 3B is a view similar to FIG. 3A showing the nut members disengaged from the bearing chocks, thereby freeing the roll package for removal from the mill pass line.
Figure 4:
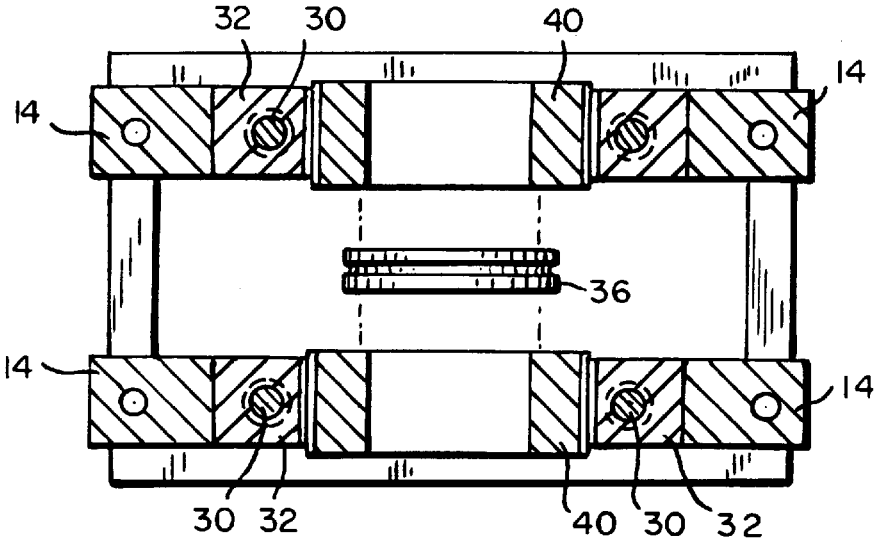
FIG. 4 is a horizontal sectional view taken along line 4—4 of FIG. 3A.

When the roll package 12 is to be extracted from the rolling line, the spindles 30 are rotated to symmetrically separate the nut members 32, 34 to the open positions shown in FIG. 3B. This results in the roll package being lowered with respect to the pass line P until the support wheels 62 come to rest on the tracks 64.

Figure 1:
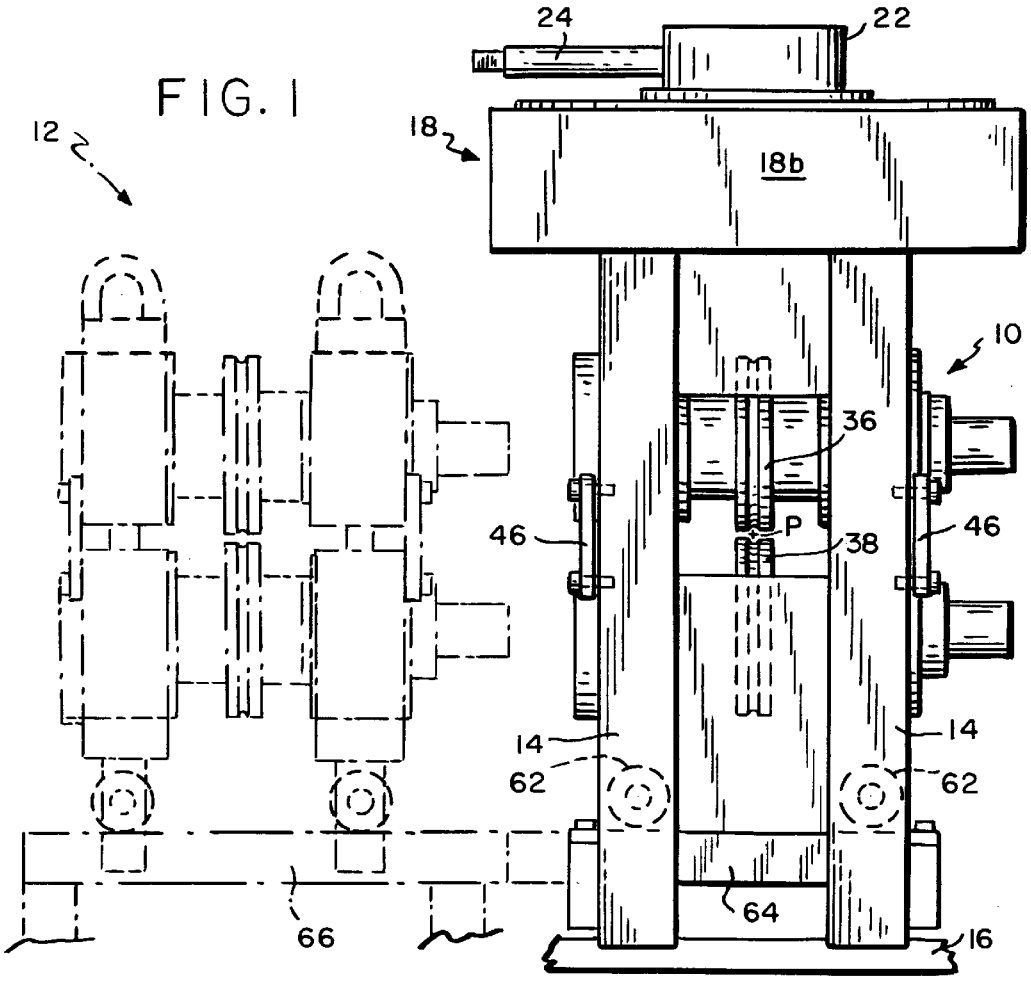
FIG. 1 is a front view of a roll stand in accordance with the present invention, with broken lines showing the roll package removed to one side of the mill pass line.

The roll package may then be extracted laterally onto adjacent tracks 66, as shown by the broken lines in FIG. 1. The spindles 30 and nut members 32, 34 remain with the frame on the pass line. A spare roll package may then be reinserted in the frame and brought into a rolling position by operating the spindles 30 to symmetrically return the nut members to their closed clamped positions as shown in FIG. 3A.

In light of the foregoing, it will now be appreciated by those skilled in the art that considerable savings can be realized by divorcing the nut members 32, 34 and spindles 30 from the chocks 40, 42 of the roll packages. This advantage is realized without in any way compromising the ease with which roll packages may be interchanged when the mill is down for maintenance.

I claim:

1. A rolling mill roll stand, comprising:

a roll package including first and second work rolls, and bearing chocks between which the work rolls are supported for rotation about parallel axes; and a frame for locating said roll package on a mill pass line, said frame having nut members and associated adjustment means for symmetrically shifting said nut members between closed positions engaging the bearing chocks of said first and second work rolls in directions urging said work rolls towards said pass line, and open positions disengaged from said bearing chocks to thereby accommodate removal of said roll package from said frame.

2. The roll stand as claimed in claim 1 wherein said adjustment means comprises spindles extending between the nut members engaging adjacent bearing chocks of said first and second work rolls, said spindles having opposite hand screw segments threaded in respective ones of said nut members, whereupon rotation of said spindles will produce a symmetrical shifting of said nut members with respect to said mill pass line.

3. The roll stand as claimed in claim 1 wherein said frame is provided with a track system underlying said roll package, and wherein shifting said nut members to said open positions results on said roll package being deposited in said track system for removal from said frame.

4. The roll stand as claimed in claim 2 wherein said nut members engage said bearing chocks at interfaces which are inclined with respect to the vertical.

5. The roll stand as claimed in claim 4 wherein the angle of inclination of said interfaces is no greater than 75°.

6. The roll stand as claimed in claim 3 wherein shifting said nut members to said closed positions results in said roll package being elevated above said track system.

7. A rolling mill roll stand, comprising:

a roll package including a pair of work rolls each having bearing chocks for supporting said work rolls for rotation about parallel axes; and a frame for locating said roll package on a pass line, said frame having nut members and associated adjustment means for symmetrically shifting said nut members between closed positions engaging and symmetrically urging said bearing chocks and their respective work rolls inwardly towards said pass line to thereby control the parting between said work rolls, and open positions disengaged from said bearing chocks to thereby accommodate removal of said roll package from said frame.

8. The roll stand as claimed in claim 1 wherein said roll package further comprises means acting between said bearing chocks for yieldably separating said work rolls.

9. The roll stand as claimed in claim 1 wherein said roll package further comprises means for interconnecting the bearing chocks of one work roll to the bearing chocks of the other work roll.

10. The roll stand as claimed in claim 1 wherein said nut members are arranged to engage said bearing chocks at opposite sides of said roll package.

11. The roll stand as claimed in claim 1 further comprising means interposed between adjacent bearing chocks of said roll package for yieldably urging said bearing chocks apart.

12. The roll stand as claimed in claim 9 wherein said means for interconnecting comprises link members extending from the bearing chocks of one work roll to the adjacent bearing chocks of the other work roll.

13. The roll stands as claimed in claim 12 wherein said link members are configured to accommodate limited separation between chocks and their respective work rolls.

14. The roll stand as claimed in claim 11 further comprising link members extending between and interconnecting adjacent bearing chocks of said roll package.

15. The roll stand as claimed in claim 14 wherein said link members are configured to a accommodate limited relative movement between adjacent bearing chocks of said roll package.

* * * * *